US012338732B2

(12) United States Patent
He et al.

(10) Patent No.: US 12,338,732 B2
(45) Date of Patent: Jun. 24, 2025

(54) QUANTITATIVE PREDICTION METHOD FOR GAS CONTENT OF DEEP MARINE SHALE

(71) Applicants: Southwest Petroleum University, Chengdu (CN); Sinopec Southwest Petroleum Bureau Co., Ltd, Chengdu (CN); PetroChina Zhejiang Oilfield Company, Hangzhou (CN)

(72) Inventors: Xinyang He, Chengdu (CN); Kun Zhang, Chengdu (CN); Hulin Niu, Chengdu (CN); Chengzao Jia, Chengdu (CN); Yan Song, Chengdu (CN); Zhenxue Jiang, Chengdu (CN); Shu Jiang, Chengdu (CN); Xueying Wang, Chengdu (CN); Nanxi Zhang, Chengdu (CN); Xiaoxia Dong, Chengdu (CN); Jun Dong, Chengdu (CN); Ruisong Li, Chengdu (CN); Tong Wang, Chengdu (CN); Pu Huang, Chengdu (CN); Jiasui Ouyang, Chengdu (CN); Xingmeng Wang, Chengdu (CN); Shoucheng Xu, Chengdu (CN); Hanbing Zhang, Hangzhou (CN); Yubing Ji, Hangzhou (CN); Lei Chen, Chengdu (CN); Xuefei Yang, Chengdu (CN); Fengli Han, Chengdu (CN); Weishi Tang, Chengdu (CN); Jingru Ruan, Chengdu (CN); Hengfeng Gou, Chengdu (CN); Lintao Li, Chengdu (CN); Yipeng Liu, Chengdu (CN); Ping Liu, Chengdu (CN)

(73) Assignees: Southwest Petroleum University, Chengdu (CN); Sinopec Southwest Petroleum Bureau Co., Ltd, Chengdu (CN); PetroChina Zhejiang Oilfield Company, Hangzhou (CN)

( * ) Notice: Subject to any disclaimer, the term of this patent is extended or adjusted under 35 U.S.C. 154(b) by 0 days.

(21) Appl. No.: 18/918,078

(22) Filed: Oct. 17, 2024

(65) Prior Publication Data

US 2025/0129717 A1 Apr. 24, 2025

(30) Foreign Application Priority Data

Oct. 24, 2023 (CN) ..... 202311386727.3

(51) Int. Cl.
*E21B 49/00* (2006.01)

(52) U.S. Cl.
CPC ..... *E21B 49/008* (2013.01); *E21B 2200/22* (2020.05)

(58) Field of Classification Search
CPC ..... E21B 49/008; E21B 2200/22
See application file for complete search history.

(56) References Cited

U.S. PATENT DOCUMENTS

2014/0366621 A1* 12/2014 Valenza ..... G01N 15/082 73/152.05
2024/0385348 A1* 11/2024 Xiang ..... G01V 20/00

FOREIGN PATENT DOCUMENTS

CN 109427018 A * 3/2019
CN 108982287 B * 9/2020
CN 112304843 B * 9/2022

OTHER PUBLICATIONS

Xin et al; Evaluation of the in-place adsorbed gas content of organic-rich shales. Year: 2021.*

(Continued)

*Primary Examiner* — Arleen M Vazquez
*Assistant Examiner* — Lynda Dinh

(57) ABSTRACT

A quantitative prediction method for gas content of deep marine shale includes: obtaining raw data of known wells;

(Continued)

establishing relationship formulas between pore specific surface areas and adsorbed gas contents of a known well in an area as an adsorbed gas content quantitative prediction model; establishing relationship formulas between pore volumes and free gas contents of the known well as a free gas content quantitative prediction model; summing the adsorbed gas contents and corresponding free gas contents to obtain total gas contents; calculating adsorbed gas contents, free gas contents and total gas contents of the known wells; drawing a predicted adsorbed gas content contour map, a predicted free gas content contour map and a predicted total gas content contour map; and reading an adsorbed gas content, a free gas content and a total gas content of an unknown well in the area from the above contour maps.

5 Claims, 3 Drawing Sheets

(56) References Cited

OTHER PUBLICATIONS

Wei et al; Investigation of gas content of organic-rich shale:A case study from Lower Permian shale. Year 2016.*
IP.com—Summary.*
Google scholar.*
Qin Ruibao et al., Artificial-intelligence and machine learning models of coalbed methane content based on geophysical logging data: A case study in Shizhuang South Block of Qinshui Basin, China[J]Geophysical Prospecting for Petroleum, Jan. 2023, pp. 68-79, vol. 62—issue 1.
Gao Fenglin, Reservoir characteristics of continental shale and its influences on gas-bearing properties: A case study of Shahezi Shale in the Changling Fault Depression, Chinese Doctoral Dissertations Full-text Database Basic Sciences, Jan. 15, 2021, pp. 6-7, 9, 101, 115-116, vol. 01.

* cited by examiner

QUANTITATIVE PREDICTION METHOD FOR GAS CONTENT OF DEEP MARINE SHALE

CROSS-REFERENCE TO RELATED APPLICATION

This application claims priority to Chinese Patent Application No. 20231138672.7, filed on Oct. 24, 2023, which is herein incorporated by reference in its entirety.

TECHNICAL FIELD

The disclosure relates to the field of shale gas extraction technologies, and more particularly to a quantitative prediction method for gas content of a deep marine shale.

BACKGROUND

In recent years, China has launched exploration and development work of shale gas, and has basically mastered main technologies for exploration and development of medium and shallow shale gas. However, the exploration and development of deep marine shale gas is still in its infancy. Deep marine shale gas resources have huge potential and are an important oil replacement energy source in China. Therefore, how to select calculation parameters of gas content in deep marine shale and quantitatively predict and evaluate the gas content in the deep marine shale is crucial.

Previous studies have shown that the deep marine shale gas can be divided into adsorbed gas and free gas according to its occurrence state. A correlation analysis method is currently mainly used for quantitatively predicting the gas content in the deep marine shale. First, various influencing factors of an adsorbed gas content and various influencing factors of a free gas content are identified, and a prediction model between the adsorbed gas content and the various influencing factors thereof, and a prediction model between the free gas content and the various influencing factors thereof are established. According to the prediction models, the adsorbed gas content and the free gas content are calculated to calculate a total gas content, to thereby achieve a purpose of quantitative prediction. However, due to the large number of influencing factors of the adsorbed gas content and the free gas content, this method requires a large amount of experimental data (such as a total organic carbon content abbreviated as TOC content, a porosity, a water saturation, a clay mineral content, a formation temperature and a formation pressure) to support, and does not eliminate the mutual influence between the influencing factors. The method is costly and has low accuracy.

SUMMARY

Aiming at problems that current prediction methods for gas content of deep marine shale have a large amount of used data, complex process and low prediction accuracy, the disclosure provides a quantitative prediction method for shale gas content in deep marine.

The quantitative prediction method for shale gas content provided by the disclosure includes:

S1, obtaining raw data; where the raw data includes adsorbed gas contents, free gas contents, pore specific surface areas and pore volumes of shale samples at different sampling depths of a known well in an area;

and a depth difference between two adjacent sampling depths $h_{i-1}$ and $h_1$ of the different sampling depths is 10 meters (m), and $i \geq 2$;

where each of the adsorbed gas contents is obtained by using a methane adsorption isotherm experiment;

where each of the total gas contents is obtained by using an on-site testing method based on pressure-holding coring, and each of the free gas contents is a difference between the total gas content and a corresponding one of the adsorbed gas contents; and where the pore specific surface areas and the pore volumes are obtained by using at least one selected from the group consisting of a pore structure characterization method based on carbon dioxide adsorption experiment, a pore structure characterization method based on nitrogen adsorption experiment and a pore structure characterization method based on high-pressure mercury injection experiment;

S2, establishing, based on the raw data, relationship formulas between the pore specific surface areas and the adsorbed gas contents of the known well as an adsorbed gas content quantitative prediction model; where the step S2 specifically includes:

S21, expressing the pore specific surface areas as x, and expressing the adsorbed gas contents as y, to form a first discrete series $[x_i, y_i]$; where $x_i$ represents a pore specific surface area of a shale sample at an $i^{th}$ sampling depth $h_i$ of the known well, and $y_i$ represents an adsorbed gas content of the shale sample at the $i^{th}$ sampling depth $h_i$ of the known well;

S22, obtaining linear equations of straight lines passing through every two adjacent points $(x_{i-1}, y_{i-1})$ and $(x_i, y_i)$ as adsorbed gas content prediction formulas corresponding to different burial depths; where the step S22 specifically includes:

(1) expressing a first linear equation of a first straight line passing through two points $(x_1, y_1)$ and $(x_2, y_2)$ as $y-y_1=k_1(x-x_1)$, substituting the two points $(x_1, y_1)$ and $(x_2, y_2)$ into the first linear equation $y-y_1=k_1(x-x_1)$ to obtain a first slope $k_1$, and obtaining the first linear equation of the first straight line passing through the two points $(x_1, y_1)$ and $(x_2, y_2)$ based on the first slope, expressed as a formula 1 as follows:

$$y = k_1(x - x_1) + y_1; \quad \text{(formula 1)}$$

where the formula 1 is an adsorbed gas content prediction formula corresponding to a first burial depth range of $h_1$ to $h_2$;

(2) expressing a second linear equation of a second straight line passing through two points $(x_2, y_2)$ and $(x_3, y_3)$ as $y-y_2=k_2(x-x_2)$, substituting the two points $(x_2, y_2)$ and $(x_3, y_3)$ into the second linear equation $y-y_2=k_2(x-x_2)$ to obtain a second slope $k_2$, and obtaining the second linear equation of the second straight line passing through the two points $(x_2, y_2)$ and $(x_3, y_3)$ based on the second slope, expressed as a formula 2 as follows:

$$y = k_2(x - x_2) + y_2; \quad \text{(formula 2)}$$

where the formula 2 is an adsorbed gas content prediction formula corresponding to a second burial depth range of $h_2$ to $h_3$;

(3) expressing a third linear equation of a third straight line passing through two points $(x_3, y_3)$ and $(x_4, y_4)$ as $y-y_3=k_3(x-x_3)$, substituting the two points $(x_3, y_3)$ and $(x_4, y_4)$ into the third linear equation $y-y_3=k_3(x-x_3)$ to obtain a third slope $k_3$, obtaining the third linear equation of the third straight line passing through the two points $(x_3, y_3)$ and $(x_4, y_4)$ based on the third slope, expressed as a formula 3 as follows:

$$y = k_3(x - x_3) + y_3; \quad \text{(formula 3)}$$

where the formula 3 is an adsorbed gas content prediction formula corresponding to a third burial depth range of $h_3$ to $h_4$; and (4) expressing a $(i-1)^{th}$ linear equation of a $(i-1)^{th}$ straight line passing through every two adjacent points $(x_{i-1}, y_{i-1})$ and $(x_i, y_i)$ as $y-y_{i-1}=k_{i-1}(x-x_{i-1})$, wherein $i\geq 5$, substituting the two points $(x_{i-1}, y_{i-1})$ and $(x_i, y_i)$ into the $(i-1)^{th}$ linear equation $y-y_{i-1}=k_{i-1}(x-x_{i-1})$ to obtain a $(i-1)^{th}$ slope $k_{i-1}$, and obtaining the $(i-1)^{th}$ linear equation of the $(i-1)^{th}$ straight line passing through the two adjacent points $(x_{i-1}, y_{i-1})$ and $(x_i, y_i)$ based on the $(i-1)^{th}$ slope, expressed as follows:

$$y = k_{i-1}(x - x_{i-1}) + y_{i-1};$$

where the $(i-1)^{th}$ linear equation $y=k_{i-1}(x-x_{i-1})+y_{i-1}$ is an adsorbed gas content prediction formula corresponding to $(i-1)^{th}$ a burial depth range of $h_{i-1}$ to $h_i$;

S23, predicting, according to the adsorbed gas content prediction formulas corresponding to the different burial depths, adsorbed gas contents at the different burial depths in segment by segment; and S24, averaging the adsorbed gas contents at the different burial depths predicted in the step S23 to obtain an adsorbed gas content $Q_{a1}$ of the known well;

S3, establishing relationship formulas between the pore volumes and the free gas contents of the known well as a free gas content quantitative prediction model; where the step S3 specifically includes:

expressing the pore volumes as u, and expressing the free gas contents as v, to form a second discrete series $[u_i, v_i]$; where $u_i$ represents a pore volume of the shale sample at the $i^{th}$ sampling depth $h_i$, and $v_i$ represents a free gas content of the shale sample at the $i^{th}$ sampling depth $h_i$; and obtaining a free gas content $Q_{b1}$ of the known well according to a same method of the steps S22-S24;

S4, summing the adsorbed gas content $Q_{ai}$ and the free gas content $Q_{b1}$ to obtain a total gas content $Q_{total\ 1}$ of of the known well;

S5, performing the steps S1-S4 to determine an adsorbed gas content, a free gas content and a total gas content of each of other known wells in the area, to thereby obtain an adsorbed gas content $Q_{ai}$, a free gas content $Q_{bi}$ and a total gas content $Q_{total\ i}$ of each known well in the area; and S6, drawing a contour map of predicted adsorbed gas content, a contour map of predicted free gas content and a contour map of predicted total gas content of the area according to the adsorbed gas content $Q_{ai}$, the free gas content $Q_{bi}$ and the total gas content $Q_{total\ i}$ of each known well in the area obtained in the step S5; reading a predicted adsorbed gas content $Q_{ax}$, a predicted free gas content $Q_{bx}$ and a predicted total gas content $Q_{total\ x}$ of an unknown well in the area from the contour map of predicted adsorbed gas content, the contour map of predicted free gas content and the contour map of predicted total gas content.

In an embodiment, in the step S6, after the reading a predicted adsorbed gas content $Q_{ax}$, a predicted free gas content $Q_{bx}$ and a predicted total gas content $Q_{total\ x}$ of an unknown well in the area from the contour map of predicted adsorbed gas content, the contour map of predicted free gas content and the contour map of predicted total gas content, the step S6 further includes:

summing the predicted adsorbed gas content $Q_{ax}$ and the predicted free gas content $Q_{bx}$ of the unknown well in the area to obtain a calculated total gas content $Q_{ab}$ of the unknown well in the area; and averaging the calculated total gas content $Q_{ab}$ and the predicted total gas content $Q_{total\ x}$ as a total gas content of the unknown well in the area.

In an embodiment, the embodiment of the disclosure provides a quantitative prediction method for shale gas content, including:

S1, performing a methane adsorption isotherm experiment to obtain adsorbed gas contents of shale samples at different sampling depths of a known well in an area, performing an on-site testing method based on pressure-holding coring to obtain total gas contents of the shale samples at the different sampling depths of the known well in the area, calculating differences between the total gas contents and corresponding adsorbed gas contents to obtain free gas contents of the shale samples at the different sampling depths of the known well in the area, and performing at least one selected from the group consisting of a pore structure characterization method based on carbon dioxide adsorption experiment, a pore structure characterization method based on nitrogen adsorption experiment and a pore structure characterization method based on high-pressure mercury injection experiment to obtain pore specific surface areas and pore volumes of the shale samples at the different sampling depths of the known well in the area; where a depth difference between two adjacent sampling depths $h_{i-1}$ and $h_i$ of the different sampling depths is 10 m, and $i\geq 2$;

S2, establishing relationship formulas between the pore specific surface areas and the adsorbed gas contents of the known well as an adsorbed gas content quantitative prediction model; where the step S2 specifically includes:

S21, expressing the pore specific surface areas as x, and expressing the adsorbed gas contents as y, to form a first discrete series $[x_i, y_i]$; where $x_i$ represents a pore specific surface area of a shale sample at an $i^{th}$ sampling depth $h_i$ of the known well, and $y_i$ represents an adsorbed gas content of the shale sample at the $i^{th}$ sampling depth $h_i$ of the known well;

S22, obtaining linear equations of straight lines passing through every two adjacent points $(x_{i-1}, y_{i-1})$ and $(x_i,$ $y_i$) as adsorbed gas content prediction formulas corresponding to different burial depths; where the step S22 specifically includes:

(1) expressing a first linear equation of a first straight line passing through two points ($x_1$, $y_1$) and ($x_2$, $y_2$) as $y-y_1=k_1(x-x_1)$, substituting the two points ($x_1$, $y_1$) and ($x_2$, $y_2$) into the first linear equation $y-y_1=k_1(x-x_1)$ to obtain a first slope $k_1$, and obtaining the first linear equation of the first straight line passing through the two points ($x_1$, $y_1$) and ($x_2$, $y_2$) based on the first slope, expressed as a formula 1 as follows:

$$y = k_1(x - x_1) + y_1; \quad \text{(formula 1)}$$

where the formula 1 is an adsorbed gas content prediction formula corresponding to a first burial depth range of $h_1$ to $h_2$;

(2) expressing a second linear equation of a second straight line passing through two points ($x_2$, $y_2$) and ($x_3$, $y_3$) as $y-y_2=k_2(x-x_2)$, substituting the two points ($x_2$, $y_2$) and ($x_3$, $y_3$) into the second linear equation $y-y_2=k_2(x-x_2)$ to obtain a second slope $k_2$, and obtaining the second linear equation of the second straight line passing through the two points ($x_2$, $y_2$) and ($x_3$, $y_3$) based on the second slope, expressed as a formula 2 as follows:

$$y = k_2(x - x_2) + y_2; \quad \text{(formula 2)}$$

where the formula 2 is an adsorbed gas content prediction formula corresponding to a second burial depth range of $h_2$ to $h_3$;

(3) expressing a third linear equation of a third straight line passing through two points ($x_3$, $y_3$) and ($x_4$, $y_4$) as $y-y_3=k_3(x-x_3)$, substituting the two points ($x_3$, $y_3$) and ($x_4$, $y_4$) into the third linear equation $y-y_3=k_3(x-x_3)$ to obtain a third slope $k_3$, obtaining the third linear equation of the third straight line passing through the two points ($x_3$, $y_3$) and ($x_4$, $y_4$) based on the third slope, expressed as a formula 3 as follows:

$$y = k_3(x - x_3) + y_3; \quad \text{(formula 3)}$$

where the formula 3 is an adsorbed gas content prediction formula corresponding to a third burial depth range of $h_3$ to $h_4$; and (4) expressing a $(i-1)^{th}$ linear equation of a $(i-1)^{th}$ straight line passing through every two adjacent points ($x_{i-1}$, $y_{i-1}$) and ($x_i$, $y_i$) as $y-y_{i-1}=k_{i-1}(x-x_{i-1})$, wherein $i\geq 5$, substituting the two points ($x_{i-1}$, $y_{i-1}$) and ($x_i$, $y_i$) into the $(i-1)^{th}$ linear equation $y-y_{i-1}=k_{i-1}(x-x_{i-1})$ to obtain a $(i-1)^{th}$ slope $k_{i-1}$, and obtaining the $(i-1)^{th}$ linear equation of the $(i-1)^{th}$ straight line passing through the two adjacent points ($x_{i-1}$, $y_{i-1}$) and ($x_i$, $y_i$) based on the $(i-1)^{th}$ slope, expressed as follows:

$$y = k_{i-1}(x - x_{i-1}) + y_{i-1};$$

where the $(i-1)^{th}$ linear equation $y=k_{i-1}(x-x_{i-1})+y_{i-1}$ is an adsorbed gas content prediction formula corresponding to $(i-1)^{th}$ a burial depth range of $h_{i-1}$ to $h_i$;

S23, predicting, according to the adsorbed gas content prediction formulas corresponding to the different burial depths, adsorbed gas contents at the different burial depths in segment by segment; and S24, averaging the adsorbed gas contents at the different burial depths predicted in the step S23 to obtain an adsorbed gas content $Q_{a1}$ of the known well;

S3, establishing relationship formulas between the pore volumes and the free gas contents of the known well as a free gas content quantitative prediction model; where the step S3 specifically includes:

expressing the pore volumes as u, and expressing the free gas contents as v, to form a second discrete series [$u_i$, $v_i$]; where $u_i$ represents a pore volume of the shale sample at the $i^{th}$ sampling depth $h_i$, and $v_i$ represents a free gas content of the shale sample at the $i^{th}$ sampling depth $h_i$; and obtaining a free gas content $Q_{b1}$ of the known well according to a same method of the steps S22-S24;

S4, summing the adsorbed gas content $Q_{a1}$ and the free gas content $Q_{b1}$ to obtain a total gas content $Q_{total\ 1}$ of the known well;

S5, performing the steps S1-S4 to determine an adsorbed gas content, a free gas content and a total gas content of each of other known wells in the area, to thereby obtain an adsorbed gas content $Q_{ai}$, a free gas content $Q_{bi}$ and a total gas content $Q_{total\ i}$ of each known well in the area; and S6, drawing a contour map of predicted adsorbed gas content, a contour map of predicted free gas content and a contour map of predicted total gas content of the area according to the adsorbed gas content $Q_{ai}$, the free gas content $Q_{bi}$ and the total gas content $Q_{total\ i}$ of each known well in the area obtained in the step S5; reading a predicted adsorbed gas content $Q_{ax}$, a predicted free gas content $Q_{bx}$ and a predicted total gas content $Q_{total\ x}$ of an unknown well in the area from the contour map of predicted adsorbed gas content, the contour map of predicted free gas content and the contour map of predicted total gas content; summing the predicted adsorbed gas content $Q_{ax}$ and the predicted free gas content $Q_{bx}$ of the unknown well in the area to obtain a calculated total gas content $Q_{ab}$ of the unknown well in the area; and averaging the calculated total gas content $Q_{ab}$ and the predicted total gas content $Q_{total\ x}$ as a total gas content of the unknown well in the area.

In an exemplary embodiment, the quantitative prediction method for gas content of a deep marine shale further includes:

dividing the unknown wells in the area into three levels according to the total gas content of each unknown well in the area, specifically including:

determining an unknown well with a total gas content greater than a first threshold as a first level gas-bearing area;

determining an unknown well with a total gas content greater than a second threshold and smaller than the first threshold as a second level gas-bearing area; and determining an unknown well with a total gas content smaller than the second threshold as a third level gas bearing area; and developing shale gas in the unknown well in the area in an order of the first gas-bearing area, the second gas-bearing area and the third gas-bearing area.

Specifically, the first threshold is 11 cubic meters per ton ($m^3$/t), and the second threshold is 9 $m^3$/t.

Compared to the related art, beneficial effects of the disclosure are as follows.

(1) The prediction method of the disclosure takes the shale pore structure as a starting point to establish the relationship formulas between pore specific surface area and adsorbed gas content as the adsorbed gas content prediction model, and establish the relationship formulas between pore volume and free gas content as the free gas content prediction model. A sum of the adsorbed gas content and the free gas content is the total gas content of the shale.

(2) The prediction method of the disclosure does not require the use of a large amount of experimental data (such as a TOC content, a porosity, a water saturation, a clay mineral content, a formation temperature and a formation pressure), which is a simpler prediction method, overcomes the problems that the current prediction methods have a large amount of used data, large amount of calculation, and complex process. In addition, the prediction method of the disclosure has no mutual influence between the various influencing factors, and the accuracy is higher.

Other advantages, purposes and features of the disclosure are embodied in part through the following description, and in part will be understood by those skilled in the art through study and practice of the disclosure.

DETAILED DESCRIPTION OF EMBODIMENTS

Figure 1:
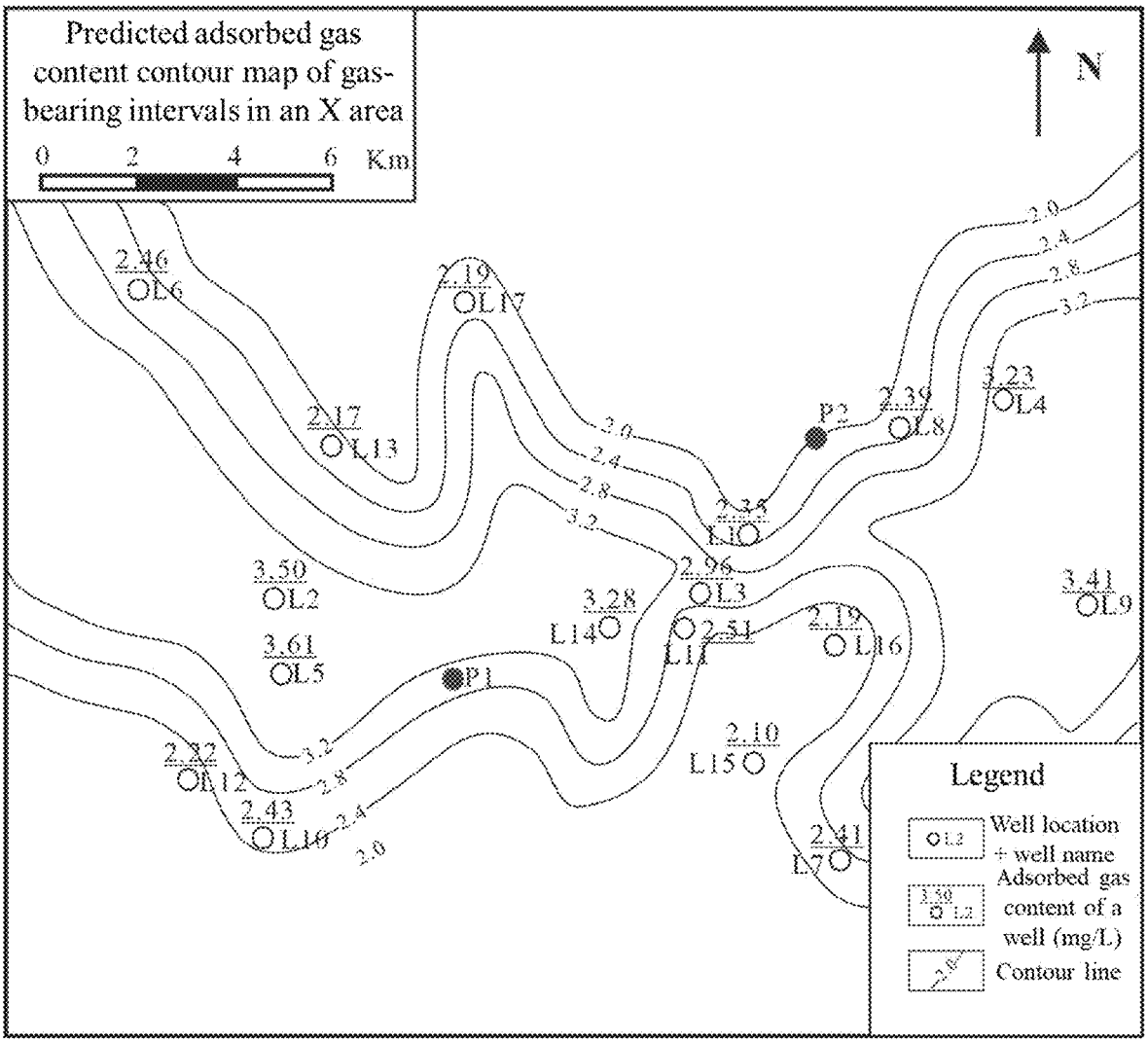
FIG. 1 illustrates a contour map of predicted adsorbed gas contents of gas-bearing intervals in an X area according to an embodiment of the disclosure.

Embodiments of the disclosure are described in conjunction with drawings. It should be understood that the described embodiments are merely used for describing and explaining the disclosure, and are not used to limit the disclosure.

In step S1, raw data is obtained, the raw data includes adsorbed gas contents, free gas contents, pore specific surface areas and pore volumes of shale samples at different sampling depths of a known well in an area. For example, Table 1 shows raw experimental data of a L1 well in an X area.

The adsorbed gas contents are obtained by using a methane adsorption isotherm experiment.

The total gas contents are obtained by using an on-site testing method based on pressure-holding coring, and each of the free gas contents is a difference between the total gas content and a corresponding one of the adsorbed gas contents.

The pore specific surface areas and the pore volumes are obtained by using at least one selected from the group consisting of a pore structure characterization method based on carbon dioxide adsorption experiment, a pore structure characterization method based on nitrogen adsorption experiment and a pore structure characterization method based on high-pressure mercury injection experiment.

TABLE 1

Raw experimental raw data of the L1 well in the X area

| Sampling depth (m) | Adsorbed gas content (milliliter per gram abbreviated as mL/g) | Free gas content (mL/g) | Pore specific surface area (square micrometer per gram abbreviated as $\mu m^2$/g) | Pore volume (mL/g) |
|---|---|---|---|---|
| 3680 | 2.32 | 6.34 | 168.8013742 | 0.22177386 |
| 3690 | 1.96 | 5.69 | 150.9857815 | 0.20228551 |
| 3700 | 2.07 | 6.06 | 155.5690009 | 0.23259485 |
| 3710 | 2.11 | 6.62 | 158.8504315 | 0.24244343 |
| 3720 | 2.56 | 7.03 | 197.3862395 | 0.27527079 |
| 3730 | 2.30 | 5.40 | 178.3853437 | 0.18039102 |
| 3740 | 1.99 | 6.38 | 156.4011937 | 0.23142291 |
| 3750 | 2.28 | 6.87 | 167.0308136 | 0.26120689 |
| 3760 | 2.65 | 6.79 | 217.5375609 | 0.25062694 |
| 3770 | 2.44 | 7.27 | 192.1446012 | 0.32218894 |

In step S2, relationship formulas between the pore specific surface areas and the adsorbed gas contents of the known well are established as an adsorbed gas content quantitative prediction model. The pore specific surface areas are expressed as x, and the adsorbed gas contents are expressed as y, to thereby form a first discrete series $[x_i, y_i]$.

a. A linear equation of a straight line passing through two points $(x_1, y_1)=(168.8013742, 2.32)$ and $(x_2, y_2)=(150.9857815, 1.96)$ is expressed as $y-y_1=k_1(x-x_1)$, the two points $(x_1, y_1)$ and $(x_2, y_2)$ are substituted into the linear equation $y-y_1=k_1(x-x_1)$ to obtain a slope $k_1=0.0202078$, and the linear equation of the straight line passing through the two points $(x_1, y_1)=(168.8013742, 2.32)$ and $(x_2, y_2)=(150.9857815, 1.96)$ is obtained based on the slope $k_1=0.0202078$, and expressed as a formula 1 as follows:

$$y = 0.0202078(x - 168.8013742) + 2.32. \quad \text{(formula 1)}$$

b. A linear equation of a straight line passing through two points $(x_2, y_2)=(150.9857815, 1.96)$ and $(x_3, y_3)=(155.5690009, 2.07)$ is expressed as $y-y_2=k_2(x-x_2)$, the two points $(x_2, y_2)$ and $(x_3, y_3)$ are substituted into the linear equation $y-y_2=k_2(x-x_2)$ to obtain a slope $k_2=0.0240006$, and the linear equation of the straight line passing through the two points $(x_2, y_2)=(150.9857815, 1.96)$ and $(x_3, y_3)=(155.5690009, 2.07)$ is obtained based on the slope $k_2=0.0240006$, and expressed as a formula 2 as follows:

$$y = 0.0240006(x - 150.9857815) + 1.96. \quad \text{(formula 2)}$$

c. A linear equation of a straight line passing through two points $(x_3, y_3)=(155.5690009, 2.07)$ and $(x_4, y_4)=(158.8504315, 2.11)$ is expressed as $y-y_3=k_3(x-x_3)$, the two points $(x_3, y_3)$ and $(x_4, y_4)$ are substituted into the linear equation $y-y_3=k_3(x-x_3)$ to obtain a slope $k_3=0.0121898$, and the linear equation of the straight line passing through the two points $(x_3, y_3)=(155.5690009, 2.07)$ and $(x_4, y_4)=(158.8504315, 2.11)$ is obtained based on the slope $k_3=0.0121898$, and expressed as a formula 3 as follows:

$$y = 0.0121898(x - 155.5690009) + 2.07. \quad \text{(formula 3)}$$

d. A linear equation of a straight line passing through two points $(x_4, y_4)=(158.8504315, 2.11)$ and $(x_5, y_5)=(197.3862395, 2.56)$ is expressed as $y-y_4=k_4(x-x_4)$, the two points $(x_4, y_4)$ and $(x_5, y_5)$ are substituted into the linear equation $y-y_4=k_4(x-x_4)$ to obtain a slope $k_4=0.0116775$, and the linear equation of the straight line passing through the two points $(x_4, y_4)=(158.8504315, 2.11)$ and $(x_5, y_5)=(197.3862395, 2.56)$ is obtained based on the slope $k_4=0.0116775$, and expressed as a formula 4 as follows:

$$y = 0.0116775(x - 158.8504315) + 2.11. \quad \text{(formula 4)}$$

e. A linear equation of a straight line passing through two points $(x_5, y_5)=(197.3862395, 2.56)$ and $(x_6, y_6)=(178.3853437, 2.30)$ is expressed as $y-y_5=k_5(x-x_5)$, the two points $(x_5, y_5)$ and $(x_6, y_6)$ are substituted into the linear equation $y-y_5=k_5(x-x_5)$ to obtain a slope $k_5=0.0136836$, and the linear equation of the straight line passing through the two points $(x_5, y_5)=(197.3862395, 2.56)$ and $(x_6, y_6)=(178.3853437, 2.30)$ is obtained based on the slope $k_5=0.0136836$, and expressed as a formula 5 as follows:

$$y = 0.0136836(x - 197.3862395) + 2.56 \quad \text{(formula 5)}$$

f. A linear equation of a straight line passing through two points $(x_6, y_6)=(178.3853437, 2.30)$ and $(x_7, y_7)=(156.4011937, 1.99)$ is expressed as $y-y_6=k_6(x-x_6)$, the two points $(x_6, y_6)$ and $(x_7, y_7)$ are substituted into the linear equation $y-y_6=k_6(x-x_6)$ to obtain a slope $k_6=0.0141011$, and the linear equation of the straight line passing through the two points $(x_6, y_6)=(178.3853437, 2.30)$ and $(x_7, y_7)=(156.4011937, 1.99)$ is obtained based on the slope $k_6=0.0141011$, and expressed as a formula 6 as follows:

$$y = 0.0141011(x - 178.3853437) + 2.30. \quad \text{(formula 6)}$$

g. A linear equation of a straight line passing through two points $(x_7, y_7)=(156.4011937, 1.99)$ and $(x_8, y_8)=(167.0308136, 2.28)$ is expressed as $y-y_7=k_7(x-x_7)$, the two points $(x_7, y_7)$ and $(x_8, y_8)$ are substituted into the linear equation $y-y_7=k_7(x-x_7)$ to obtain a slope $k_7=0.0272823$, and the linear equation of the straight line passing through the two points $(x_7, y_7)=(156.4011937, 1.99)$ and $(x_8, y_8)=(167.0308136, 2.28)$ is obtained based on the slope $k_7=0.0272823$, and expressed as a formula 7 as follows:

$$y = 0.0272823(x - 156.4011937) + 1.99. \quad \text{(formula 7)}$$

h. A linear equation of a straight line passing through two points $(x_8, y_8)=(167.0308136, 2.28)$ and $(x_9, y_9)=(217.5375609, 2.65)$ is expressed as $y-y_8=k_8(x-x_8)$, the two points $(x_8, y_8)$ and $(x_9, y_9)$ are substituted into the linear equation $y-y_8=k_8(x-x_8)$ to obtain a slope $k_8=0.0073258$, and the linear equation of the straight line passing through the two points $(x_8, y_8)=(167.0308136, 2.28)$ and $(x_9, y_9)=(217.5375609, 2.65)$ is obtained based on the slope $k_8=0.0073258$, and expressed as a formula 8 as follows:

$$y = 0.0073258(x - 167.0308136) + 2.28. \quad \text{(formula 8)}$$

i. A linear equation of a straight line passing through two points $(x_9, y_9)=(217.5375609, 2.65)$ and $(x_{10}, y_{10})=(192.1446012, 2.44)$ is expressed as $y-y_9=k_9(x-x_9)$, the two points $(x_9, y_9)$ and $(x_{10}, y_{10})$ are substituted into the linear equation $y-y_9=k_9(x-x_9)$ to obtain a slope $k_9=0.0082700$, and the linear equation of the straight line passing through the two points $(x_9, y_9)=(217.5375609, 2.65)$ and $(x_{10}, y_{10})=(192.1446012, 2.44)$ is obtained based on the slope $k_9=0.0082700$, and expressed as a formula 9 as follows:

$$y = 0.0082700(x - 217.5375609) + 2.65. \quad \text{(formula 9)}$$

Finally, the adsorbed gas content is predicted in segment by segment according to the formulas 1-9 and the burial depth (unit is m). When the burial depth is in a range of (3680, 3690), the formula 1 is used for prediction. When the burial depth is in a range of (3690, 3700), the formula 2 is used for prediction, and so on. When the burial depth is in a range of (3760, 3770), the formula 9 is used for prediction to obtain final prediction results of the adsorbed gas contents of the burial depths from 3680 m to 3770 m of the L1 well in the X area, and the final prediction results are shown in Table 2.

TABLE 2

Prediction results of the adsorbed gas contents of the L1 well in the X area

| Sampling depth (m) | Pore specific surface area ($\mu m^2/g$) | Adsorbed gas content (mL/g) | Sampling depth (m) | Pore specific surface area ($\mu m^2/g$) | Adsorbed gas content (mL/g) |
|---|---|---|---|---|---|
| 3680 | 168.8013742 | 2.32 | 3730 | 178.3853437 | 2.30 |
| 3685 | 157.3546371 | 2.09 | 3735 | 176.3537485 | 2.27 |
| 3690 | 150.9857815 | 1.96 | 3740 | 156.4011937 | 1.99 |
| 3695 | 163.2648589 | 2.25 | 3745 | 204.5274823 | 3.30 |
| 3700 | 155.5690009 | 2.07 | 3750 | 167.0308136 | 2.28 |
| 3705 | 149.4537482 | 2.00 | 3755 | 199.3558352 | 2.52 |
| 3710 | 158.8504315 | 2.11 | 3760 | 217.5375609 | 2.65 |
| 3715 | 195.3434673 | 2.54 | 3765 | 210.2537413 | 2.59 |
| 3720 | 197.3862395 | 2.56 | 3770 | 192.1446012 | 2.44 |
| 3725 | 184.4537295 | 2.38 | | | |

The above prediction results are averaged to obtain an average adsorbed gas content of the L1 well in the X area as 2.35 mL/g.

In step S3, relationship formulas between the pore volumes and the free gas contents of the known well are established as a free gas content quantitative prediction model. The pore volumes are expressed as u, and the free gas contents are expressed as v, to thereby form a second discrete series $[u_i, v_i]$.

a. A linear equation of a straight line passing through two points $(u_1, v_1)=(0.22177386, 6.34)$ and $(u_2, v_2)=(0.20228551, 5.69)$ is expressed as $v-v_1=t_1(u-u_1)$, the two points $(u_1, v_1)$ and $(u_2, v_2)$ are substituted into the linear equation $v-v_1=t_1(u-u_1)$ to obtain a slope $t_1=33.35326659$, the linear equation of the straight line passing through the two points $(u_1, v_1)=(0.22177386, 6.34)$ and $(u_2, v_2)=(0.20228551, 5.69)$ is obtained based on the slope $t_1=33.35326659$, and expressed as a formula 10 as follows:

$$v = 33.35326659(u - 0.22177386) + 6.34. \quad \text{(formula 10)}$$

b. A linear equation of a straight line passing through two points $(u_2, v_2)=(0.20228551, 5.69)$ and $(u_3, v_3)=(0.23259485, 6.06)$ is expressed as $v-v_2=t_2(u-u_2)$, the two points $(u_2, v_2)$ and $(u_3, v_3)$ are substituted into the linear equation $v-v_2=t_2(u-u_2)$ to obtain a slope $t_2=12.20745784$, and the linear equation of the straight line passing through the two points $(u_2, v_2)=(0.20228551, 5.69)$ and $(u_3, v_3)=(0.23259485, 6.06)$ is obtained based on the slope $t_2=12.20745784$, and expressed as a formula 11 as follows:

$$v = 12.20745784(u - 0.20228551) + 5.69. \quad \text{(formula 11)}$$

c. A linear equation of a straight line passing through two points $(u_3, v_3)=(0.23259485, 6.06)$ and $(u_4, v_4)=(0.24244343, 6.62)$ is expressed as $v-v_3=t_3(u-u_3)$, the two points $(u_3, v_3)$ and $(u_4, v_4)$ are substituted into the linear equation $v-v_3=t_3(u-u_3)$ to obtain a slope $t_3=56.86101211$, and the linear equation of the straight passing through the two points $(u_3, v_3)=(0.23259485, 6.06)$ and $(u_4, v_4)=(0.24244343, 6.62)$ is obtained based on the slope $t_3=56.86101211$, and expressed as a formula 12 as follows:

$$v = 56.86101211(u - 0.23259485) + 6.06. \quad \text{(formula 12)}$$

d. A linear equation of a straight line passing through two points $(u_4, v_4)=(0.24244343, 6.62)$ and $(u_5, v_5)=(0.27527079, 7.03)$ is expressed as $v-v_4=t_4(u-u_4)$, the two points $(u_4, v_4)$ and $(u_5, v_5)$ are substituted into the linear equation $v-v_4=t_4(u-u_4)$ to obtain a slope $t_4=12.48958124$, and the linear equation of the straight line passing through the two points $(u_4, v_4)=(0.24244343, 6.62)$ and $(u_5, v_5)=(0.27527079, 7.03)$ is obtained based on the slope $t_4=12.48958124$, and expressed as a formula 14 as follows:

$$v = 12.48958124(u - 0.24244343) + 6.62. \quad \text{(formula 13)}$$

e. A linear equation of a straight line passing through two points $(u_5, v_5)=(0.27527079, 7.03)$ and $(u_6, v_6)=(0.18039102, 5.40)$ is expressed as $v-v_5=t_5(u-u_5)$, the two points $(u_5, v_5)$ and $(u_6, v_6)$ are substituted into the linear equation $v-v_5=t_5(u-u_5)$ to obtain a slope $t_5=17.17963707$, and the linear equation of the straight line passing through the two points $(u_5, v_5)=(0.27527079, 7.03)$ and $(u_6, v_6)=(0.18039102, 5.40)$ is obtained based on the slope $t_5=17.17963707$, and expressed as a formula 14 as follows:

$$v = 17.17963707(u - 0.27527079) + 7.03. \quad \text{(formula 14)}$$

f. A linear equation of a straight line passing through two points $(u_6, v_6)=(0.18039102, 5.40)$ and $(u_7, v_7)=(0.23142291, 6.38)$ is expressed as $v-v_6=t_6(u-u_6)$, the two points $(u_6, v_6)$ and $(u_7, v_7)$ are substituted into the linear equation $v-v_6=t_6(u-u_6)$ to obtain a slope $t_6=19.20367903$, and the linear equation of the straight line passing through the two points $(u_6, v_6)=(0.18039102, 5.40)$ and $(u_7, v_7)=(0.23142291, 6.38)$ is obtained based on the slope $t_6=19.20367903$, and expressed as a formula 15 as follows:

$$v = 19.20367903(u - 0.18039102) + 5.40. \quad \text{(formula 15)}$$

g. A linear equation of a straight line passing through two points ($u_7$, $v_7$)=(0.23142291, 6.38) and ($u_8$, $v_8$)=(0.26120689, 6.87) is expressed as $v-v_7=t_7(u-u_7)$, the two points ($u_7$, $v_7$) and ($u_8$, $v_8$) are substituted into the linear equation $v-v_7=t_7(u-u_7)$ to obtain a slope $t_7$=16.45179623, and the linear equation of the straight line passing through the two points ($u_7$, $v_7$)=(0.23142291, 6.38) and ($u_8$, $v_8$)=(0.26120689, 6.87) is obtained based on the slope $t_7$=16.45179623, and expressed as a formula 16 as follows:

$$v = 16.45179623(u - 0.23142291) + 6.38. \quad \text{(formula 16)}$$

h. A linear equation of a straight line passing through two points ($u_8$, $v_8$)=(0.26120689, 6.87) and ($u_9$, $v_9$)=(0.25062694, 6.79) is expressed as $v-v_8=t_8(u-u_8)$, the two points ($u_8$, $v_8$) and ($u_9$, $v_9$) are substituted into the linear equation $v-v_8=t_8(u-u_8)$ to obtain a slope $t_8$=7.56146989, and the linear equation of the straight line passing through the two points ($u_8$, $v_8$)=(0.26120689, 6.87) and ($u_9$, $v_9$)=(0.25062694, 6.79) is obtained based on the slope $t_8$=7.56146989, and expressed as a formula 17 as follows:

$$v = 7.56146989(u - 0.26120689) + 6.87. \quad \text{(formula 17)}$$

i. A linear equation of a straight line passing through two points ($u_9$, $v_9$)=(0.25062694, 6.79) and ($u_{10}$, $v_{10}$)=(0.32218894, 7.27) is expressed as $v-v_9=t_9(u-u_9)$, the two points ($u_9$, $v_9$) and ($u_{10}$, $v_{10}$) are substituted into the linear equation $v-v_9=t_9(u-u_9)$ to obtain a slope $t_9$=6.70747021, and the linear equation of the straight line passing through the two points ($u_9$, $v_9$)=(0.25062694, 6.79) and ($u_{10}$, $v_{10}$)=(0.32218894, 7.27) is obtained based on the slope $t_9$=6.70747021, and expressed as a formula 18 as follows:

$$v = 6.70747021(u - 0.25062694) + 6.79. \quad \text{(formula 18)}$$

Finally, the free gas content is predicted in segment by segment according to the formulas 10-18 and the burial depth (unit is m). When the burial depth is in a range of (3680, 3690), the formula 10 is used for prediction. When the burial depth is in a range of (3690, 3700), the formula 11 is used for prediction, and so on. When the burial depth is in a range of (3760, 3770), the formula 18 is used for prediction to obtain final prediction results of the free gas contents of the burial depths from 3680 m to 3770 m of the L1 well in the X area, and the final prediction results are shown in Table 3.

TABLE 3

Prediction results of the free gas contents of the L1 well in the X area

| Sampling depth (m) | Pore volume (mL/g) | Free gas content (mL/g) | Sampling depth (m) | Pore volume (mL/g) | Free gas content (mL/g) |
|---|---|---|---|---|---|
| 3680 | 0.22177386 | 6.34 | 3730 | 0.18039102 | 5.40 |
| 3685 | 0.35456384 | 10.77 | 3735 | 0.29638491 | 7.63 |

TABLE 3-continued

Prediction results of the free gas contents of the L1 well in the X area

| Sampling depth (m) | Pore volume (mL/g) | Free gas content (mL/g) | Sampling depth (m) | Pore volume (mL/g) | Free gas content (mL/g) |
|---|---|---|---|---|---|
| 3690 | 0.20228551 | 5.69 | 3740 | 0.23142291 | 6.38 |
| 3695 | 0.29374858 | 6.81 | 3745 | 0.33748595 | 8.12 |
| 3700 | 0.23259485 | 6.06 | 3750 | 0.26120689 | 6.87 |
| 3705 | 0.26648593 | 7.99 | 3755 | 0.28464757 | 7.05 |
| 3710 | 0.24244343 | 6.62 | 3760 | 0.25062694 | 6.79 |
| 3715 | 0.31034647 | 7.47 | 3765 | 0.27394955 | 6.95 |
| 3720 | 0.27527079 | 7.03 | 3770 | 0.32218894 | 7.27 |
| 3725 | 0.21648549 | 6.02 | | | |

The above prediction results are averaged to obtain an average free gas content of the L1 well in the X area as 7.01 mL/g. The average adsorbed gas content is added with the average free gas content to obtain an average total gas content of the L1 well in the X area as 9.36 mL/g.

Similarly, the predicted gas contents of all known wells in the X area are obtained, and the predicted results are shown in Table 4.

TABLE 4

Prediction results of the gas contents of all known wells in the X area

| Well name | Predicted adsorbed gas content (mL/g) | Predicted free gas content (mL/g) | Predicted total gas content (mL/g) |
|---|---|---|---|
| L1 | 2.35 | 6.68 | 9.36 |
| L2 | 3.5 | 9.39 | 12.89 |
| L3 | 2.96 | 9.06 | 12.02 |
| L4 | 3.23 | 8.51 | 11.74 |
| L5 | 2.61 | 8.9 | 11.51 |
| L6 | 2.46 | 8.98 | 11.44 |
| L7 | 2.41 | 8.45 | 10.87 |
| L8 | 2.39 | 8.39 | 10.78 |
| L9 | 3.41 | 7.13 | 10.55 |
| L10 | 2.43 | 7.91 | 10.34 |
| L11 | 2.51 | 7.58 | 10.09 |
| L12 | 2.22 | 6.71 | 8.93 |
| L13 | 2.17 | 6.76 | 8.93 |
| L14 | 3.28 | 5.27 | 8.55 |
| L15 | 2.1 | 6.29 | 8.39 |
| L16 | 2.19 | 5.49 | 7.68 |
| L17 | 2.19 | 4.91 | 7.10 |

Figure 2:
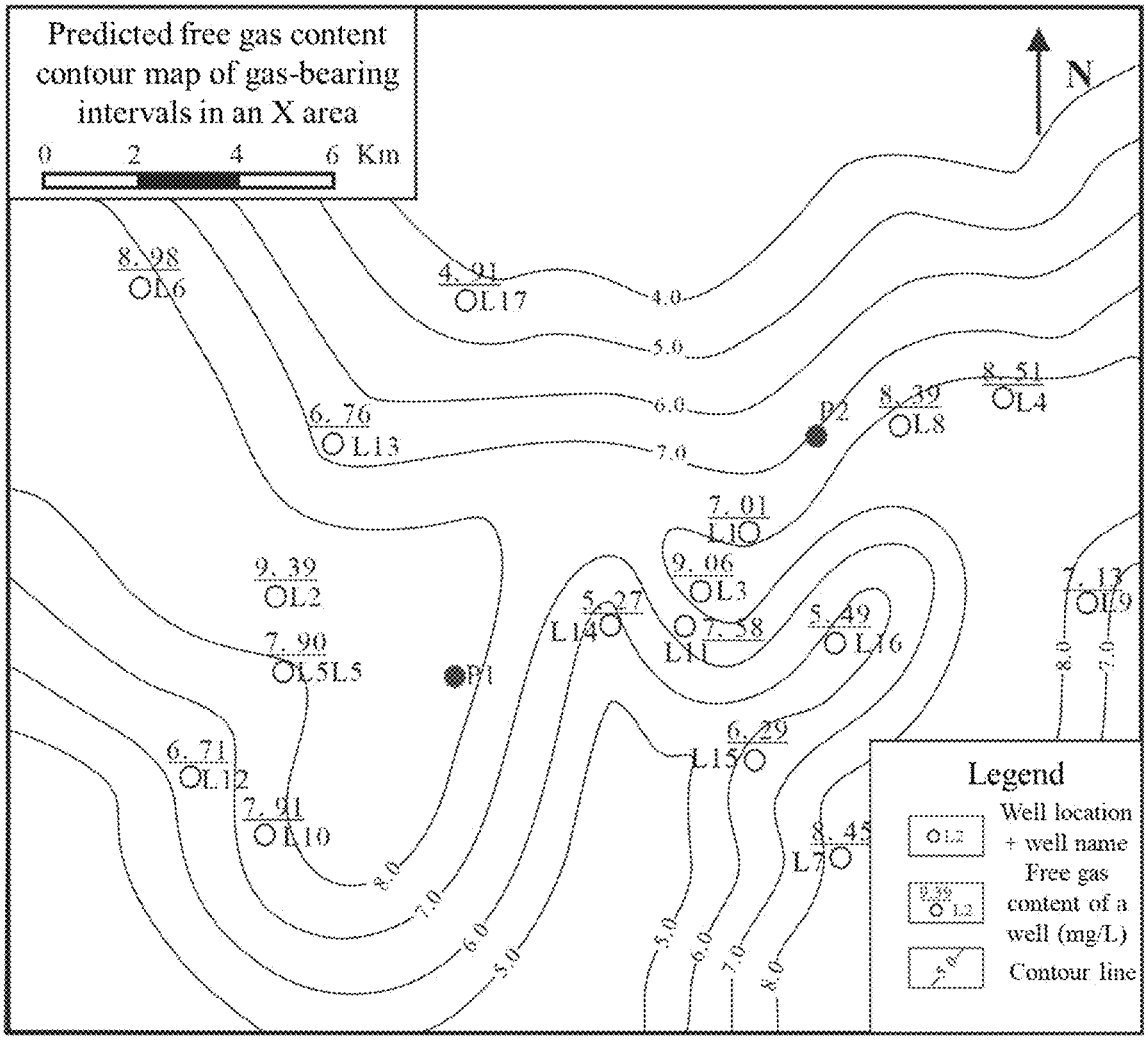
FIG. 2 illustrates a contour map of predicted free gas contents of gas-bearing intervals in the X area according to an embodiment of the disclosure.
Figure 3:
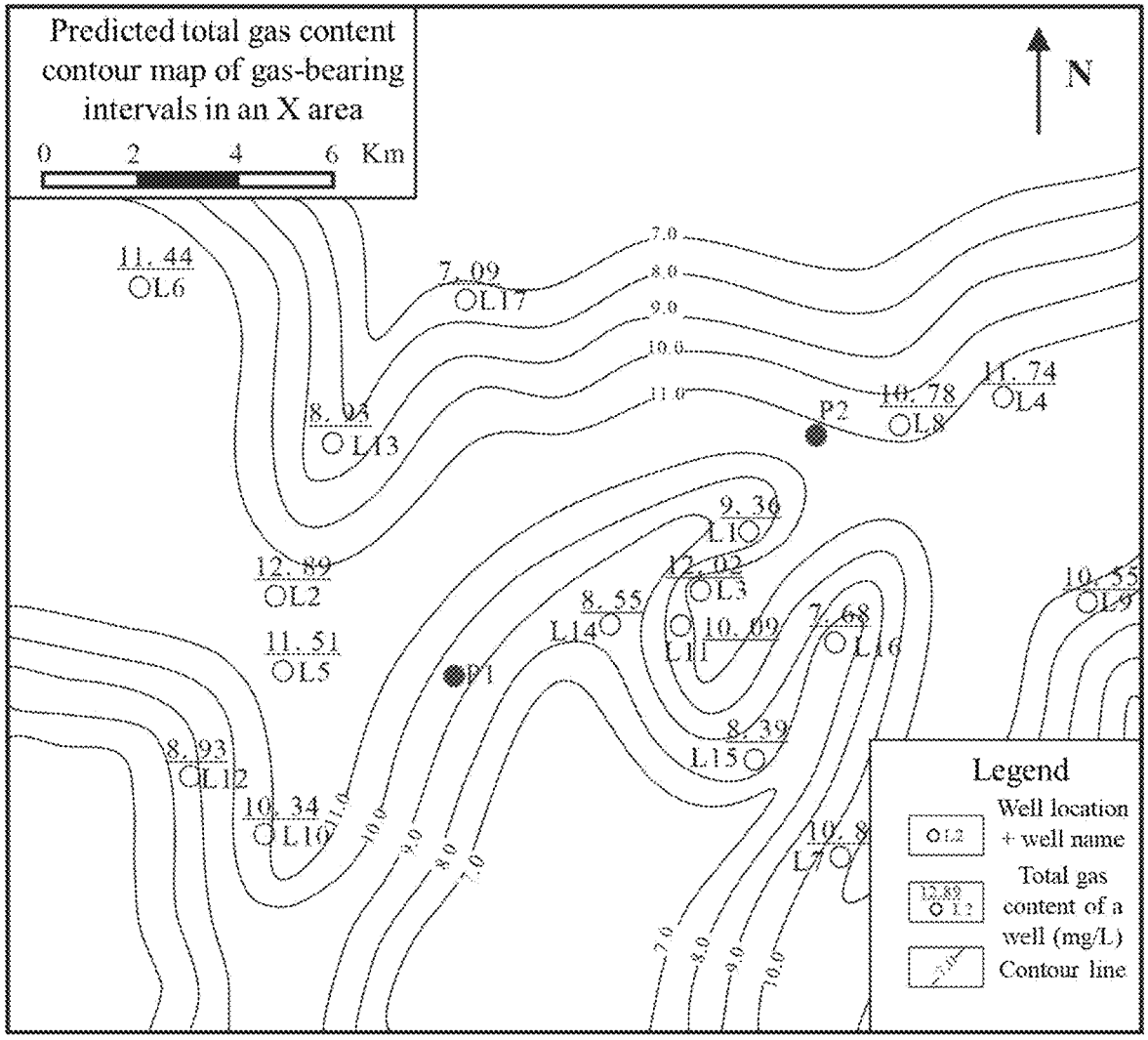
FIG. 3 illustrates a contour map of predicted total gas contents of gas-bearing intervals in the X area according to an embodiment of the disclosure.

A contour map of predicted adsorbed gas content (as shown in FIG. 1), a contour map of predicted free gas content (as shown in FIG. 2) and a contour map of predicted total gas content (as shown in FIG. 3) of the X area are drawn according to the prediction results of the gas contents of all known wells in the X area.

For any unknown well in the area, an adsorbed gas content, a free gas content and a total gas content of an unknown well in the area are read from the above contour maps. For example, for a P1 well in the X area, it can be seen from FIG. 1 that the P1 well is located between a contour line corresponding to the adsorbed gas content of 2.8 milliliters per gram (mL/g) and a contour line corresponding to the adsorbed gas content of 3.2 mL/g, thus an average between 2.8 mL/g and 3.2 mL/g is used as the adsorbed gas content of the P1 well, that is, the adsorbed gas content of the P1 well is about 3.0 mL/g. Similarly, it can be read from FIG. 2 that the free gas content of the P1 well is about 8.1 mL/g, the total gas content of the P1 well is calculated by summing the adsorbed gas content and the free gas content, and a calculated value of the total gas content is 11.1 mL/g. It can be read from FIG. 3 that a read value of the total gas content is about 9.5 mL/g, and the calculated value and the read value of the total gas content are averaged to obtain the total gas content of the P1 well is 10.3 mL/g.

Similarly, for a P2 well in the X area, it can be read from FIG. 1 that the adsorbed gas content of the P2 well is about 2.0 mL/g, it can be read from FIG. 2 that the free gas content of the P2 well is about 7.0 mL/g, the total gas content of the P2 well is calculated by summing the adsorbed gas content and the free gas content, and a calculated value of the total gas content is 9.0 mL/g. It can be read from FIG. 3 that a read value of the total gas content is about 11.2 mL/g, and the calculated value and the read value of the total gas content are averaged to obtain the total gas content of the P2 well is 10.1 mL/g.

The above description is merely some of the embodiments of the disclosure, and does not limit the disclosure in any form. Although the disclosure has been disclosed in the embodiments, it is not intended to limit the disclosure. Any one of those skilled in the art can use the disclosed technical content to make slight changes or amendments to equivalent embodiments without departing from a scope of the technical solutions of the disclosure. Any simple amendments, equivalent changes, and amendments made to the above embodiments based on the technical essence of the disclosure without departing from the technical solution of the disclosure still belong to the scope of the technical solution of the disclosure.

What is claimed is:

1. A quantitative prediction method for shale gas content, comprising:

S1, obtaining raw data; wherein the raw data comprises adsorbed gas contents, a free gas contents, pore specific surface areas and pore volumes of shale samples at different sampling depths of a known well in an area; and a depth difference between two adjacent sampling depths $h_{i-1}$ and $h_i$ of the different sampling depths is 10 m, $i \geq 2$, and i is a natural number;

S2, establishing, based on the raw data, relationship formulas between the pore specific surface areas and the adsorbed gas contents of the known well as an adsorbed gas content quantitative prediction model; wherein the step S2 comprises:

S21, expressing the pore specific surface areas as x, and expressing the adsorbed gas contents as y, to form a first discrete series $[x_i, y_i]$; wherein $x_i$ represents a pore specific surface area of a shale sample at an $i^{th}$ sampling depth $h_i$ of the known well, and $y_i$ represents an adsorbed gas content of the shale sample at the $i^{th}$ sampling depth $h_i$ of the known well;

S22, obtaining linear equations of straight lines passing through every two adjacent points $(x_{i-1}, y_{i-1})$ and $(x_i, y_i)$ as adsorbed gas content prediction formulas corresponding to different burial depths; wherein the step S22 specifically comprises:

(1) expressing a first linear equation of a first straight line passing through two points $(x_1, y_1)$ and $(x_2, y_2)$ as $y-y_1=k_1(x-x_1)$, substituting the two points $(x_1, y_1)$ and $(x_2, y_2)$ into the first linear equation $y-y_1=k_1(x-x_1)$ to obtain a first slope $k_1$, and obtaining the first linear equation of the first straight line passing through the two points $(x_1, y_1)$ and $(x_2, y_2)$ based on the first slope, expressed as a formula 1 as follows:

$$y = k_1(x - x_1) + y_1; \quad \text{(formula 1)}$$

wherein the formula 1 is an adsorbed gas content prediction formula corresponding to a first burial depth range of $h_1$ to $h_2$;

(2) expressing a second linear equation of a second straight line passing through two points $(x_2, y_2)$ and $(x_3, y_3)$ as $y-y_2=k_2(x-x_2)$, substituting the two points $(x_2, y_2)$ and $(x_3, y_3)$ into the second linear equation $y-y_2=k_2(x-x_2)$ to obtain a second slope $k_2$, and obtaining the second linear equation of the second straight line passing through the two points $(x_2, y_2)$ and $(x_3, y_3)$ based on the second slope, expressed as a formula 2 as follows:

$$y = k_2(x - x_2) + y_2; \quad \text{(formula 2)}$$

wherein the formula 2 is an adsorbed gas content prediction formula corresponding to a second burial depth range of $h_2$ to $h_3$;

(3) expressing a third linear equation of a third straight line passing through two points $(x_3, y_3)$ and $(x_4, y_4)$ as $y-y_3=k_3(x-x_3)$, substituting the two points $(x_3, y_3)$ and $(x_4, y_4)$ into the third linear equation $y-y_3=k_3(x-x_3)$ to obtain a third slope $k_3$, and obtaining the third linear equation of the third straight line passing through the two points $(x_3, y_3)$ and $(x_4, y_4)$ based on the third slope, expressed as a formula 3 as follows:

$$y = k_3(x - x_3) + y_3; \quad \text{(formula 3)}$$

wherein the formula 3 is an adsorbed gas content prediction formula corresponding to a third burial depth range of $h_3$ to $h_4$; and (4) expressing a $(i-1)^{th}$ linear equation of a $(i-1)^{th}$ straight line passing through every two adjacent points $(x_{i-1}, y_{i-1})$ and $(x, y_i)$ as $y-y_{i-1}=k_{i-1}(x-x_{i-1})$, wherein $i \geq 5$, substituting the two points $(x_{i-1}, y_{i-1})$ and $(x_i, y_i)$ into the $(i-1)^{th}$ linear equation $y-y_{i-1}=k_{i-1}(x-x_{i-1})$ to obtain a $(i-1)^{th}$ slope $k_{i-1}$, and obtaining the $(i-1)^{th}$ linear equation of the $(i-1)^{th}$ straight line passing through the two adjacent points $(x_{i-1}, y_{i-1})$ and $(x_i, y_i)$ based on the $(i-1)^{th}$ slope, expressed as follows:

$$y = k_{i-1}(x - x_{i-1}) + y_{i-1};$$

wherein the $(i-1)^{th}$ linear equation $y=k_{i-1}(x-x_{i-1})+y_{i-1}$ is an adsorbed gas content prediction formula corresponding to a $(i-1)^{th}$ burial depth range of $h_{i-1}$ to $h_i$;

S23, predicting, according to the adsorbed gas content prediction formulas corresponding to the different burial depths, adsorbed gas contents at the different burial depths in segment by segment; and S24, averaging the adsorbed gas contents at the different burial depths predicted in the step S23 to obtain an adsorbed gas content $Q_{a1}$ of the known well;

S3, establishing relationship formulas between the pore volumes and the free gas contents of the known well as a free gas content quantitative prediction model; wherein the step S3 comprises:

expressing the pore volumes as u, and expressing the free gas contents as v, to form a second discrete series $[u_i, v_i]$; wherein $u_i$ represents a pore volume of the shale sample at the $i^{th}$ sampling depth $h_i$, and $v_i$ represents a free gas content of the shale sample at the $i^{th}$ sampling depth $h_i$; and obtaining a free gas content $Q_{b1}$ of the known well according to a same method of the steps S22-S24;

S4, summing the adsorbed gas content $Q_{a1}$ and the free gas content $Q_{b1}$ to obtain a total gas content $Q_{total\ 1}$ of the known well;

S5, performing the steps S1-S4 to determine an adsorbed gas content, a free gas content and a total gas content of each of other known wells in the area, to thereby obtain an adsorbed gas content $Q_{ai}$, a free gas content $Q_{bi}$ and a total gas content $Q_{total\ i}$ of each known well in the area; and S6, drawing a contour map of predicted adsorbed gas content, a contour map of predicted free gas content and a contour map of predicted total gas content of the area according to the adsorbed gas content $Q_{ai}$, the free gas content $Q_{bi}$ and the total gas content $Q_{total\ i}$ of each known well in the area obtained in the step S5; reading a predicted adsorbed gas content $Q_{ax}$, a predicted free gas content $Q_{bx}$ and a predicted total gas content $Q_{total\ x}$ of an unknown well in the area from the contour map of predicted adsorbed gas content, the contour map of predicted free gas content and the contour map of predicted total gas content; summing the predicted adsorbed gas content $Q_{ax}$ and the predicted free gas content $Q_{bx}$ of the unknown well in the area to obtain a calculated total gas content $Q_{ab}$ of the unknown well in the area; and averaging the calculated total gas content $Q_{ab}$ and the predicted total gas content $Q_{total\ x}$ as a total gas content of the unknown well in the area;

wherein the quantitative prediction method for gas content of a deep marine shale further comprises:

dividing the unknown wells in the area into three levels according to the total gas content of each unknown well in the area, comprising:

determining an unknown well with a total gas content greater than a first threshold as a first level gas-bearing area;

determining an unknown well with a total gas content greater than a second threshold and smaller than the first threshold as a second level gas-bearing area; and determining an unknown well with a total gas content smaller than the second threshold as a third level gas-bearing area; and developing shale gas in the unknown wells in the area in an order of the first level gas-bearing area, the second level gas-bearing area and the third level gas-bearing area, thereby eliminating various influence factors of the adsorbed gas content and the free gas content and achieving a high quantitative prediction for shale gas content in the deep marine.

2. The quantitative prediction method for shale gas content as claimed in claim 1, wherein in the step S1, each of the adsorbed gas content is obtained by using a methane adsorption isotherm experiment.

3. The quantitative prediction method for shale gas content as claimed in claim 1, wherein in the step S1, each of the total gas contents is obtained by using an on-site testing method based on pressure-holding coring, and each of the free gas contents is a difference between the total gas content and a corresponding one of the adsorbed gas contents.

4. The quantitative prediction method for shale gas content as claimed in claim 1, wherein in the step S1, the pore specific surface areas and the pore volumes are obtained by using at least one selected from the group consisting of a pore structure characterization method based on carbon dioxide adsorption experiment, a pore structure characterization method based on nitrogen adsorption experiment and a pore structure characterization method based on high-pressure mercury injection experiment.

5. A quantitative prediction method for shale gas content, comprising:

S1, performing a methane adsorption isotherm experiment to obtain adsorbed gas contents of shale samples at different sampling depths of a known well in an area, performing an on-site testing method based on pressure-holding coring to obtain total gas contents of the shale samples at the different sampling depths of the known well in the area, calculating differences between the total gas contents and corresponding adsorbed gas contents to obtain free gas contents of the shale samples at the different sampling depths of the known well in the area, and performing at least one selected from the group consisting of a pore structure characterization method based on carbon dioxide adsorption experiment, a pore structure characterization method based on nitrogen adsorption experiment and a pore structure characterization method based on high-pressure mercury injection experiment to obtain pore specific surface areas and pore volumes of the shale samples at the different sampling depths of the known well in the area; wherein a depth difference between two adjacent sampling depths $h_{i-1}$ and $h_i$ of the different sampling depths is 10 m, $i \geq 2$, and i is a natural number;

S2, establishing relationship formulas between the pore specific surface areas and the adsorbed gas contents of the known well as an adsorbed gas content quantitative prediction model; where the step S2 comprises:

S21, expressing the pore specific surface areas as x, and expressing the adsorbed gas contents as y, to form a first discrete series $[x_i, y_i]$; wherein $x_i$ represents a pore specific surface area of a shale sample at an $i^{th}$ sampling depth $h_i$ of the known well, and $y_i$ represents an adsorbed gas content of the shale sample at the $i^{th}$ sampling depth $h_i$ of the known well;

S22, obtaining linear equations of straight lines passing through every two adjacent points $(x_{i-1}, y_{i-1})$ and $(x_i, y_i)$ as adsorbed gas content prediction formulas corresponding to different burial depths; where the step S22 comprises:

(1) expressing a first linear equation of a first straight line passing through two points $(x_1, y_1)$ and $(x_2, y_2)$ as $y-y_1=k_1(x-x_1)$, substituting the two points $(x_1, y_1)$ and $(x_2, y_2)$ into the first linear equation $y-y_1=k_1(x-x_1)$ to obtain a first slope $k_1$, and obtaining the first linear equation of the first straight line passing through the two points $(x_1, y_1)$ and $(x_2, y_2)$ based on the first slope, expressed as a formula 1 as follows:

$$y = k_1(x - x_1) + y_1; \quad \text{(formula 1)}$$

wherein the formula 1 is an adsorbed gas content prediction formula corresponding to a first burial depth range of $h_1$ to $h_2$;

(2) expressing a second linear equation of a second straight line passing through two points ($x_2$, $y_2$) and ($x_3$, $y_3$) as $y-y_2=k_2(x-x_2)$, substituting the two points ($x_2$, $y_2$) and ($x_3$, $y_3$) into the second linear equation $y-y_2=k_2(x-x_2)$ to obtain a second slope $k_2$, and obtaining the second linear equation of the second straight line passing through the two points ($x_2$, $y_2$) and ($x_3$, $y_3$) based on the second slope, expressed as a formula 2 as follows:

$$y = k_2(x - x_2) + y_2; \quad \text{(formula 2)}$$

wherein the formula 2 is an adsorbed gas content prediction formula corresponding to a second burial depth range of $h_2$ to $h_3$;

(3) expressing a third linear equation of a third straight line passing through two points ($x_3$, $y_3$) and ($x_4$, $y_4$) as $y-y_3=k_3(x-x_3)$, substituting the two points ($x_3$, $y_3$) and ($x_4$, $y_4$) into the third linear equation $y-y_3=k_3(x-x_3)$ to obtain a third slope $k_3$, and obtaining the third linear equation of the third straight line passing through the two points ($x_3$, $y_3$) and ($x_4$, $y_4$) based on the third slope, expressed as a formula 3 as follows:

$$y = k_3(x - x_3) + y_3; \quad \text{(formula 3)}$$

wherein the formula 3 is an adsorbed gas content prediction formula corresponding to a third burial depth range of $h_3$ to $h_4$; and (4) expressing a $(i-1)^{th}$ linear equation of a $(i-1)^{th}$ straight line passing through every two adjacent points ($x_{i-1}$, $y_{i-1}$) and ($x_i$, $y_i$) as $y-y_{i-1}=k_{i-1}(x-x_{i-1})$, wherein $i \geq 5$, substituting the two points ($x_{i-1}$, $y_{i-1}$) and ($x_i$, $y_i$) into the $(i-1)^{th}$ linear equation $y-y_{i-1}=k_{i-1}(x-x_{i-1})$ to obtain a $(i-1)^{th}$ slope $k_{i-1}$, and obtaining the $(i-1)^{th}$ linear equation of the $(i-1)^{th}$ straight line passing through the two adjacent points ($x_{i-1}$, $y_{i-1}$) and ($x_i$, $y_i$) based on the $(i-1)^{th}$ slope, expressed as follows:

$$y = k_{i-1}(x - x_{i-1}) + y_{i-1};$$

wherein the $(i-1)^{th}$ linear equation $y=k_{i-1}(x-x_{i-1})+y_{i-1}$ is an adsorbed gas content prediction formula corresponding to a $(i-1)^{th}$ burial depth range of $h_{i-1}$ to $h_i$;

S23, predicting, according to the adsorbed gas content prediction formulas corresponding to the different burial depths, adsorbed gas contents at the different burial depths in segment by segment; and S24, averaging the adsorbed gas contents at the different burial depths predicted in the step S23 to obtain an adsorbed gas content $Q_{a1}$ of the known well;

S3, establishing relationship formulas between the pore volumes and the free gas contents of the known well as a free gas content quantitative prediction model; wherein the step S3 comprises:

expressing the pore volumes as u, and expressing the free gas contents as v, to form a second discrete series [$u_i$, $v_i$]; wherein $u_i$ represents a pore volume of the shale sample at the $i^{th}$ sampling depth $h_i$, and $v_i$ represents a free gas content of the shale sample at the $i^{th}$ sampling depth $h_i$; and obtaining a free gas content $Q_{b1}$ of the known well according to a same method of the steps S22-S24;

S4, summing the adsorbed gas content $Q_{a1}$ and the free gas content $Q_{b1}$ to obtain a total gas content $Q_{total\ 1}$ of the known well;

S5, performing the steps S1-S4 to determine an adsorbed gas content, a free gas content and a total gas content of each of other known wells in the area, to thereby obtain an adsorbed gas content $Q_{ai}$, a free gas content $Q_{bi}$ and a total gas content $Q_{total\ i}$ of each known well in the area; and S6, drawing a contour map of predicted adsorbed gas content, a contour map of predicted free gas content and a contour map of predicted total gas content of the area according to the adsorbed gas content $Q_{ai}$, the free gas content $Q_{bi}$ and the total gas content $Q_{total\ i}$ of each known well in the area obtained in the step S5; reading a predicted adsorbed gas content $Q_{ax}$, a predicted free gas content $Q_{bx}$ and a predicted total gas content $Q_{total\ x}$ of an unknown well in the area from the contour map of predicted adsorbed gas content, the contour map of predicted free gas content and the contour map of predicted total gas content; summing the predicted adsorbed gas content $Q_{ax}$ and the predicted free gas content $Q_{bx}$ of the unknown well in the area to obtain a calculated total gas content $Q_{ab}$ of the unknown well in the area; and averaging the calculated total gas content $Q_{ab}$ and the predicted total gas content $Q_{total\ x}$ as a total gas content of the unknown well in the area, the method further comprises dividing the unknown wells in the area into three levels according to the total gas content of each unknown well in the area, and developing shale gas in the unknown wells in the area in an order of the three levels gas-bearing area, thereby eliminating various influence factors of the adsorbed gas content and the free gas content and achieving a high quantitative prediction for shale gas content in the deep marine.

* * * * *